US006336416B1

(12) United States Patent
French et al.

(10) Patent No.: US 6,336,416 B1
(45) Date of Patent: Jan. 8, 2002

(54) EMBROIDERY FRAME WITH ADAPTER ARMS

(76) Inventors: Nick L. French, 571 Watson Rd., Erlanger, KY (US) 41018; Mark E. Mason, 6286 Lesourdsville Westchester Rd., Hamilton, OH (US) 45011

( * ) Notice: Subject to any disclaimer, the term of this patent is extended or adjusted under 35 U.S.C. 154(b) by 0 days.

(21) Appl. No.: 09/854,275

(22) Filed: May 11, 2001

(51) Int. Cl.[7] ..... D05C 9/04
(52) U.S. Cl. ..... 112/103
(58) Field of Search ..... 112/103, 470.14, 112/470.18, 475.11, 311, 475.18; 38/102.1, 102.91

(56) References Cited

U.S. PATENT DOCUMENTS

| | | | | |
|---|---|---|---|---|
| 3,443,536 A | | 5/1969 | Rolauffs et al. | 112/103 |
| 3,664,288 A | * | 5/1972 | Von Boden et al. | 112/103 |
| 4,981,092 A | | 1/1991 | Bauman et al. | 112/103 |
| 5,000,103 A | | 3/1991 | Beerman | 112/121.12 |
| 5,427,043 A | * | 6/1995 | Conley, Jr. et al. | 112/470.14 X |
| 5,590,613 A | | 1/1997 | Head | 112/103 |
| 5,651,325 A | | 7/1997 | Conley Jr. | 112/470.14 |
| 5,664,350 A | | 9/1997 | Moore III | 38/102.2 |
| 5,937,774 A | * | 8/1999 | Hayashi | 112/103 |
| 6,227,129 B1 | * | 5/2001 | Parker, Jr. | 112/103 |
| 6,240,863 B1 | * | 6/2001 | Vickroy et al. | 112/103 |

* cited by examiner

*Primary Examiner*—Ismael Izaguirre
(74) *Attorney, Agent, or Firm*—Womble Carlyle Sandridge & Rice, PLLC; Lewis S. Rowell

(57) ABSTRACT

An interchangeable and manually operable embroidery frame for holding an article to be embroidered using automated embroidery equipment having a base plate, and upper clamping member pivotally connected to the base plate, a clamping mechanism for biasing the upper clamping member in closed contact with the base, mounting arms extending outwardly from the base plate, and selectively removable adapters attached to each mounting arm, whereby the adapters enable the clamping frame to be mounted on a selected automated embroidery machine.

9 Claims, 8 Drawing Sheets

EMBROIDERY FRAME WITH ADAPTER ARMS

FIELD OF THE INVENTION

The present invention relates to the field of embroidery operations, and, more particularly to an improved device for holding small items to be embroidered during such operations.

BACKGROUND OF THE INVENTION

In the sewing and embroidery industry, fabric holding clamps, templates, and hoops are widely used for holding individual work pieces on single and multi-head embroidery machines. These devices are numerous, due in part to the number of different manufacturers and models of automated embroidery machines on the market and in use. For example, Tajima, Melco, Barudan, SWF, Brother, and Toyota each produce such machines. While certain features are similar, such as the general manner in which embroidery devices are mounted, these machines are neither designed nor constructed to have commonly-shaped mounts and are thus not capable of accepting fabric holding devices (frames) from other models. This means that an embroidery operation at the present time must limit itself to one model, or must purchase multiple frames of the same size and type for each of the different models in use. Most operations chose the latter course of action for economic reasons. As a result, the embroidery company must carry a different frame for each different make of machine.

An additional problem in the sewing industry associated with fabric holding devices is that, particularly for automated multi-head machines, these devices are pneumatically operated. While pneumatic controls provide some convenience for long runs, they are not conducive to operations that require frequent changing of fabric holding devices for the performance of different jobs, such as runs of small lots. Particularly for multi-head machines, the installation and hookup process for pneumatically operated machines is not only time consuming, but also requires a skilled technician to properly connect the system of pneumatic hoses to the fabric holding devices. In addition to the time, labor, and skill required, this switchover process means loss of production and thus, lost revenue, for extended periods during the production year.

SUMMARY OF THE INVENTION

The present invention is directed to a fabric holding device that addresses both of the above problems. The holding device of the present invention is manually operable, rather than pneumatically operable. The same frame can also be easily and quickly installed on various models of automated embroidery machines without the need for modifications to the machine. This results in significant labor savings and a corresponding reduction in machine down time, and hence, less loss of production. The holding device also addresses the lack of interchangeability by providing an apparatus that is interchangeably mountable on automated embroidery machines via a set of adapters that are easily switched.

One aspect of the present invention is to provide a manually operable embroidery clamping frame for holding an article to be embroidered using automated embroidery equipment. The frame includes a base frame member and an upper clamping member, which is moveable from the open to closed position manually rather than pneumatically.

The base frame member is generally rectangular and flat, having opposed front and rear ends and opposed side edges. An embroidery opening defined by the front end and opposed side edges is formed through the base. Walls extend upward from at least some portion of each opposed side edge. The walls are desirably integrally formed with the base, but may be separated affixed. Preferably, although not required, flanges are attached to and extend inwardly from the top edges of the walls for attaching the upper clamping member to the base.

The upper clamping member having opposed front and rear ends and opposed side edges is pivotally connected to the base through the upstanding walls. Upper arms are integrally formed with and extend forwardly outward in parallel relation to one another from each of the opposed side edges. An upper frame, generally rectangular in shape, is pivotally mounted between the upper arms. The ends and side edges of the upper frame define an embroidery opening corresponding approximately in size and shape to the embroidery opening in the base. When the upper clamping member is pivoted to closed contact with the base, the embroidery opening in the upper frame is in approximate registration with the embroidery opening in the base. As used herein, "registration" means that the embroidery openings align one atop the other when the base and upper frame are in closed contact. Because the upper frame is pivotally attached to the forwardly extending arms of the upper clamping member, the holding surface of the upper frame is allowed to contact the holding surface of the base simultaneously and evenly when an article is being clamped between the two. This eliminates a problem known in the art whereby the opening and closing of frames and hoops tend to pull and distort the fabric, resulting in an inferior product.

A manual clamping mechanism is provided in which the upper clamping member is pivotally attached to and normally biased toward closed gripping contact with the base. This is achieved in part by attaching a spring between the upper clamping member and the base. A lever mechanism engages the clamping member to provide the mechanical advantage to overcome the spring bias and open the clamping frame so that the embroidered article may be positioned or removed.

All models contain mounting arms that extend outwardly from the clamping mechanism. Although the embroidery stations of the different models are generally the same width in currently available models, the outer edges of the mounting arms for different models are uniquely shaped for mating, engagement with a single make of automated embroidery machine.

A second aspect of the invention is therefore to make the fabric holding device interchangeable with at least several makes of embroidery machines. To accomplish this the mounting arms must be configured differently at the outer ends. One way of accomplishing this is to make the entire mounting arm replaceable. However, preferably, the mounting arms are provided with adapter plates at the outer ends thereof. Instead of having the outer ends of the mounting arms uniquely shaped for mating engagement with a particular model of automated embroidery machine, the outer ends of the mounting arms have threaded holes formed therethrough. A plurality of adapter plates are provided, each having holes corresponding to threaded holes in the mounting arms. A selected appropriate set of adapter plates is affixed to each outer end of the mounting arms via the threaded holes on the mounting arms. The free end of each plate set is configured to mate with the embroidery frame holders of a particular embroidery machine. For example, for a Tajima machine, adapters formed to mate with that machine are removably attached to the ends of the mounting arms. For a Melco machine a different set of adapters is used. So that a single embroidery clamping device may be interchangeably used from one model to another, the adapters may be quickly and easily changed. An embroiderer will have to purchase only one frame even if two or more different models of machines are being used within the same facility.

These and other aspects of the present invention will become apparent to those skilled in the art after a reading of the following description of the preferred embodiments when considered in conjunction with the drawings. It should be understood that both the foregoing general description and the following detailed description are exemplary and explanatory only and are not restrictive of the invention as claimed.

DETAILED DESCRIPTION OF THE PREFERRED EMBODIMENTS

Figure 1:
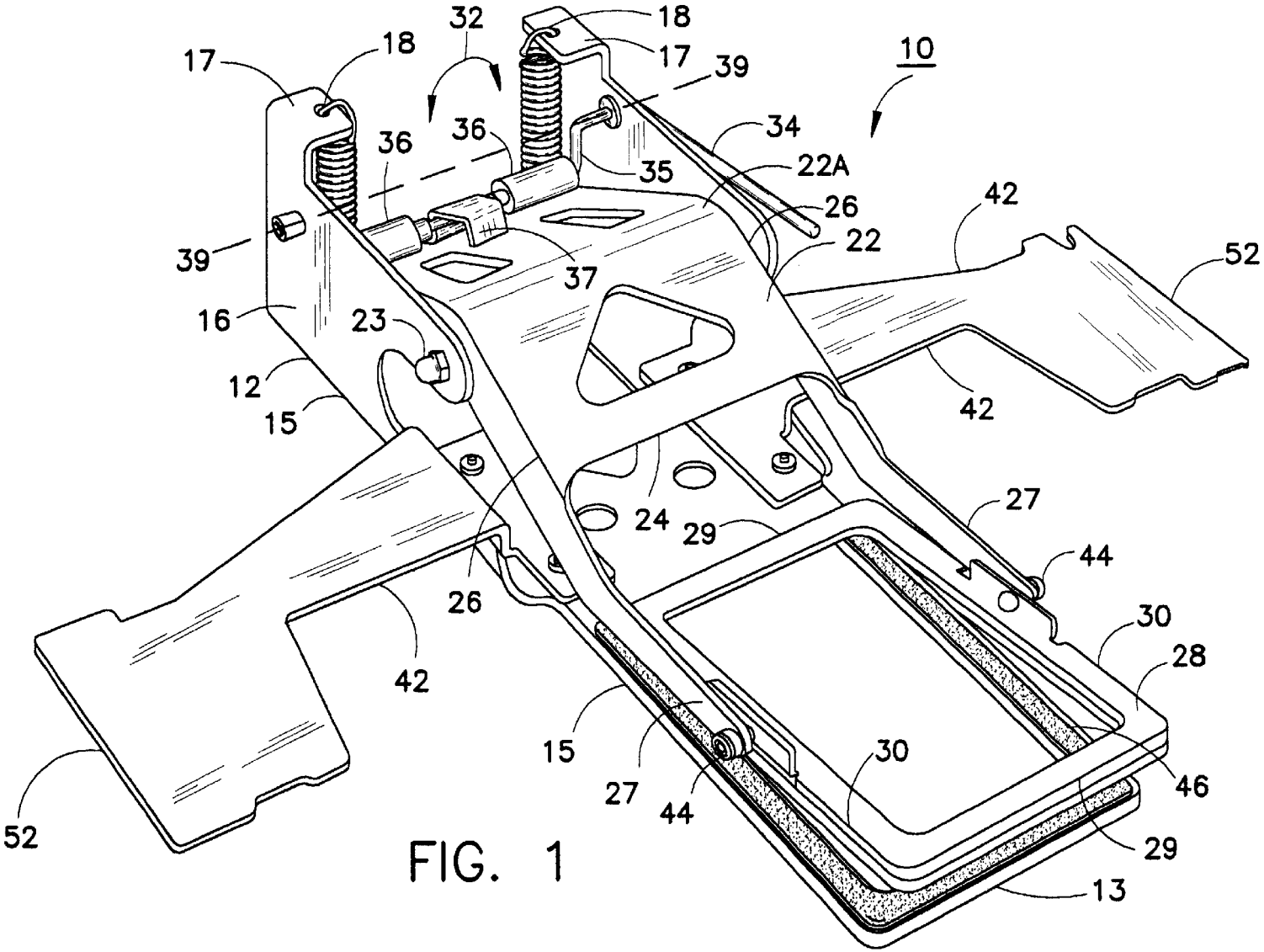
FIG. 1 is a left front perspective view of the embroidery frame of the present invention with the base and upper clamping member in the open position.

As shown in FIG. 1, the present invention is directed to a manually operable clamping frame for holding an article to be embroidered using automated embroidery equipment. Shown generally as 10, the embroidery frame includes a base 12, an upper clamping member 22, a manual clamping mechanism 32, and mounting arms 42.

Figure 2:
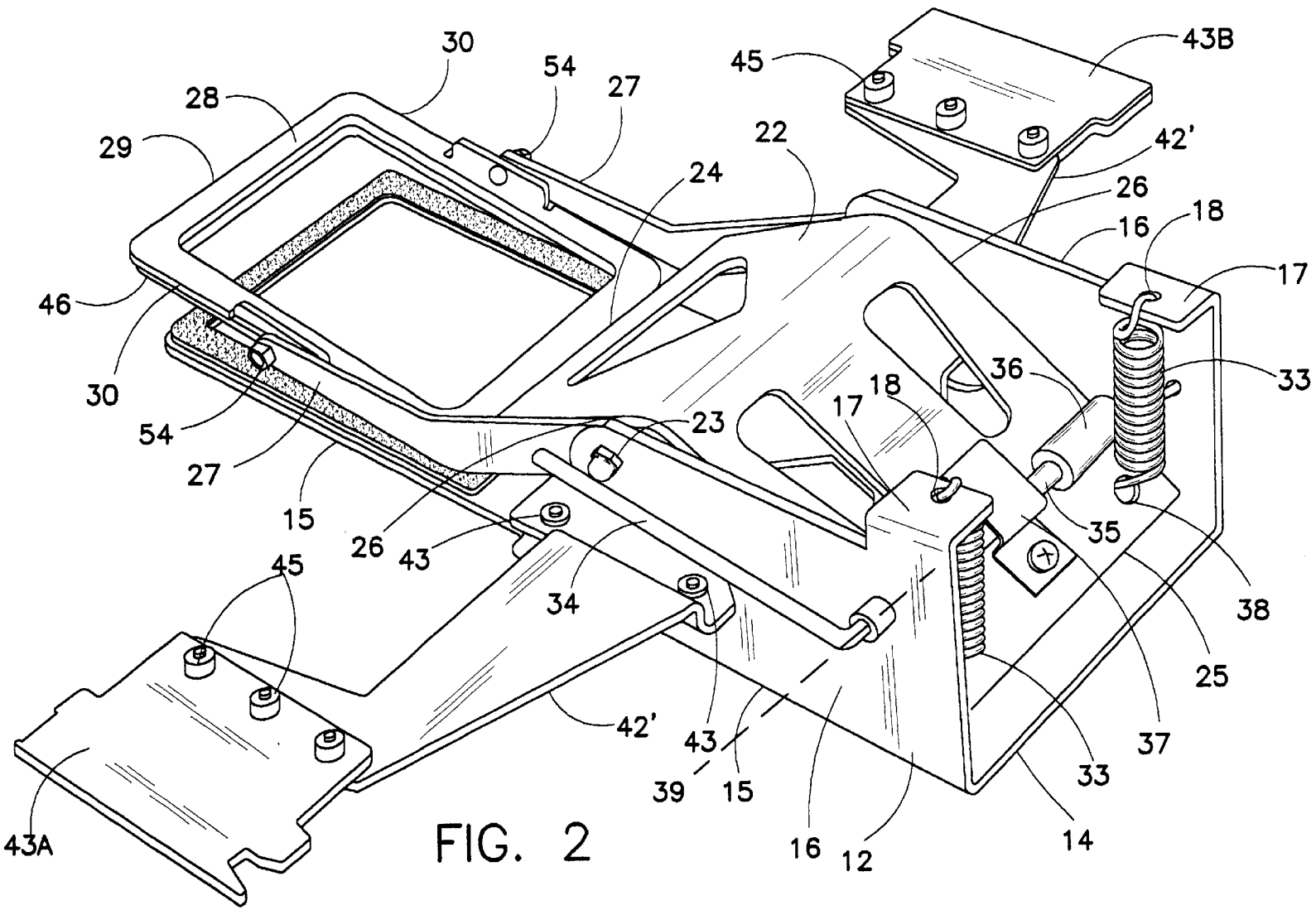
FIG. 2 is a right rear perspective view of the device of FIG. 1 with a Melco adapter plate.

FIGS. 1 and 2 are illustrative of the manually operable embroidery frame of the present invention, adaptable to an SWF embroidery machine, in an open position; i.e., the base 12 and upper clamping member 22 are not in closed contact with one another. Base 12 has opposed front and rear ends 13,14, and opposed side edges 15 forming a framed opening adjacent the front end in which the embroidery operation takes place. Walls 16 extend upwardly from at least some portion of side edges 15 forming a framed opening adjacent the front end in which the embroidery operation takes place. Walls 16 are integrally formed with base 12, but may be separately affixed. In the preferred embodiment, flanges 17 are formed with and extend inwardly from the top edges of walls 16. Apertures 18 are formed through the flanges 17 for attachment of springs 33 which hold the clamping mechanism 32 thereto as will be described hereinafter. As seen in FIGS. 1 and 2, end 13 and sides 15 define a first rectangular embroidery opening through base 12. Desirably, a non-slip material 46 such as rubber or course sandpaper is adhered around the periphery of the embroidery opening to enhance the capability of frame 10 to hold the article to be embroidered.

Upper clamping member 22 is pivotally mounted to base 12 between walls 16 with fasteners 23 extending through walls 16 and through side walls of upper clamping member 22. Fasteners 23 are comprised of an elongate rod (not shown) with threaded ends. Nuts hold the rod in an inserted position through walls 16 and clamping member 22. Alternatively, separate fasteners 23 may secure each wall 16 to opposed sides of upper clamping member 22. Upper clamping member 22 includes opposed front and rear ends 24, 25 and opposed side edges 26. As shown in FIGS. 1 and 2, the front portion of upper clamping member slopes forwardly and downwardly from peak 22A, peak 22A being in general alignment with fasteners 23. Similarly, the rear portion of upper clamping member 22 slopes rearwardly and downwardly from peak 22A. Arms 27, integrally formed and downwardly with upper clamping member 22, extend forwardly from each of said opposed side edges 26. A frame 28 is pivotally attached to and between arms 27 with fasteners 54. Fasteners 54 are screws with lock nuts, but other suitable fasteners conventionally known in the art will provide equally satisfactory results. Frame 28 is generally rectangularly shaped, having opposed front and rear edges 29 and opposed side edges 30 defining a second embroidery opening therethrough. The size of frame 28 and the corresponding embroidery opening formed therethrough are varied with the type and size of item to be embroidered. The second embroidery opening is dimensioned so that it is substantially the same size and orientation as the first embroidery opening and in registration with the first embroidery opening when the two are in closed contact. A non-slip material 47 is also adhered around the periphery of the second embroidery opening for gripping engagement.

Clamping mechanism 32 is provided to maintain the base 12 and upper clamping member 22 with frame 28 in positive closed contact. As used herein "positive closed contact" refers to a pressure exerted between the article holding surfaces that is sufficient to prevent slippage under expected operating conditions for automated embroidery machines. In the preferred embodiment, manual clamping mechanism 32 is comprised of tension springs 33, levers 34 and 35, rollers 36, and a lever channel 37. Springs 33 are attached to base 12 through slots 18 in flanges 17 and extend between flanges 17 and the rear end 25 of upper clamping member 22 where they attach through holes 38. Springs 33 tensionally bias the rear end 25 of upper clamping member 22 upwardly to urge frame 28 downwardly into closed contact with base 12. The amount of tensional holding force exerted is dependent upon the spring constant chosen for springs 33.

Figure 3:
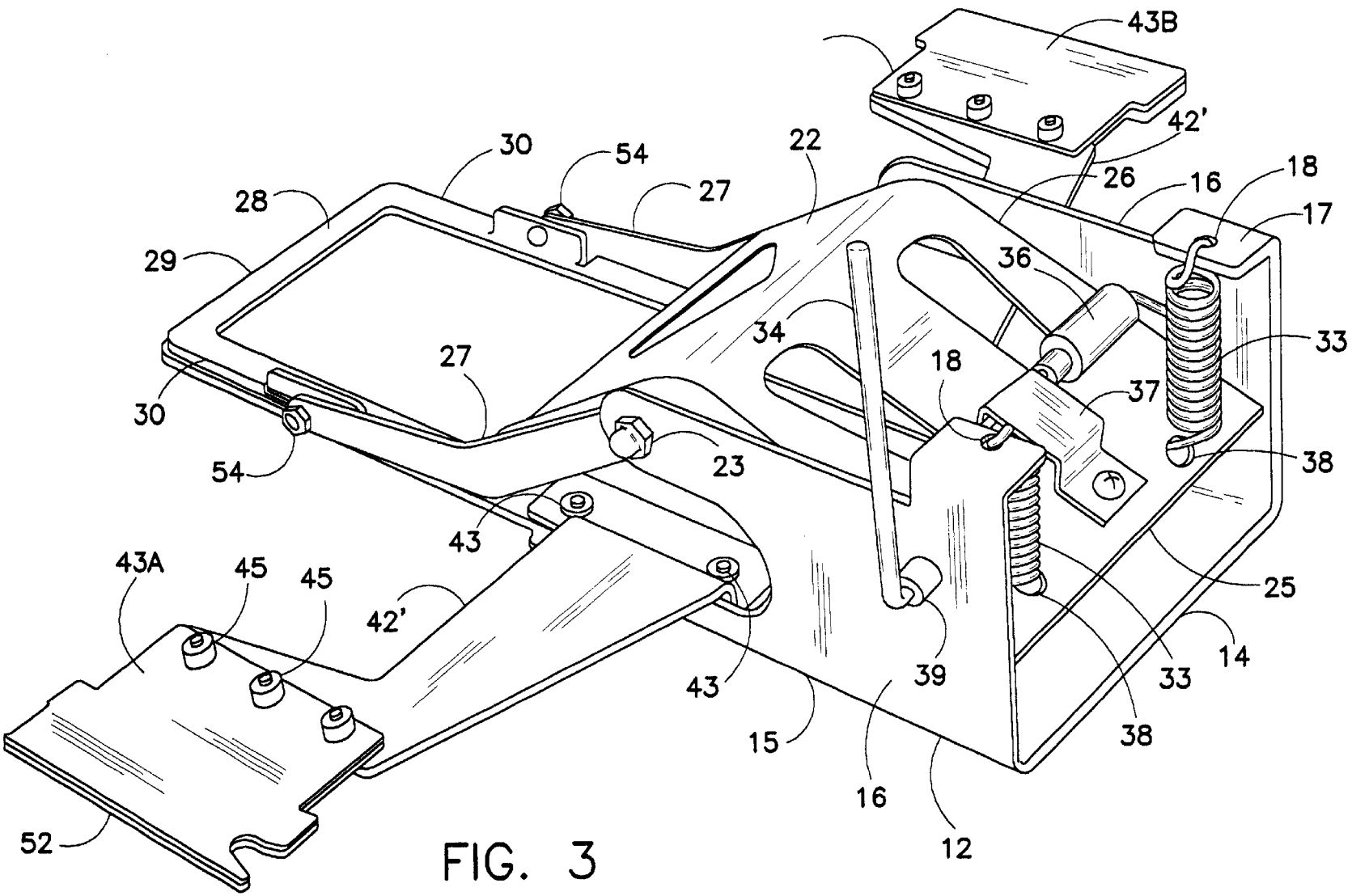
FIG. 3 is a right rear perspective view similar to FIG. 2, except with the base and upper clamping member in the closed clamping position.

As shown in FIGS. 1 and 2, levers 34 and 35 are integrally formed and connected through a common fulcrum axis 39 formed through walls 16. As best seen in FIG. 1, lever 34 is formed with a handle portion having an end bent at a right angle for insertion through fulcrum 39. The handle portion is of sufficient length to provide a mechanical advantage over springs 33. As shown in FIG. 3, the handle portion of lever 34 is normally in a vertical orientation when base 12 and upper clamping member 22 are in closed contact. Lever 35, formed through a right angle with lever 34 is in a generally horizontal orientation with its central portion contained within channel 37. Rollers 36 surround portions of lever 35 to provide for rollable movement of lever 35 against upper clamping member 22 when lever 34 is manually pulled to the forward horizontal position shown in FIGS. 1 and 2. In operation, when lever arm 34 is pulled forwardly and downwardly, lever 35 with rollers 36 is pivoted and urged downwardly and rearwardly in channel 37. This mechanical displacement overcomes the spring bias and causes upper clamping member 22 to pivot downwardly and springs 33 to stretch. The rearward pivot of upper clamping member 22 causes frame 28 to disengage from contact with base 12. When lever arm 34 is pushed upwardly and rearwardly, the exact opposite occurs. The energy in springs 33 aids in pivoting upper clamping member 22 forward in closed contact with base 12.

Referring again to FIG. 1, mounting arms 42 are attached to and extend outward from base 12. Mounting arms 42 are separately fastened to base 12 with fasteners 43 conventional in the art, such as machine screws, bolts, etc., but alternatively may be integrally formed with base 12.

A second aspect of the present invention is that clamping frame 10 is mounted to any model of automated embroidery machine without the need to move or alter any features or hardware, such as pneumatic hoses, from the embroidery machines. One way to accomplish this is to have mounting arms 42 removably attachable to base 12. By using different configurations on the extremities of the arms, the mounting arms 42 may be interchanged to fit different models of automated embroidery machines.

Figure 2A:
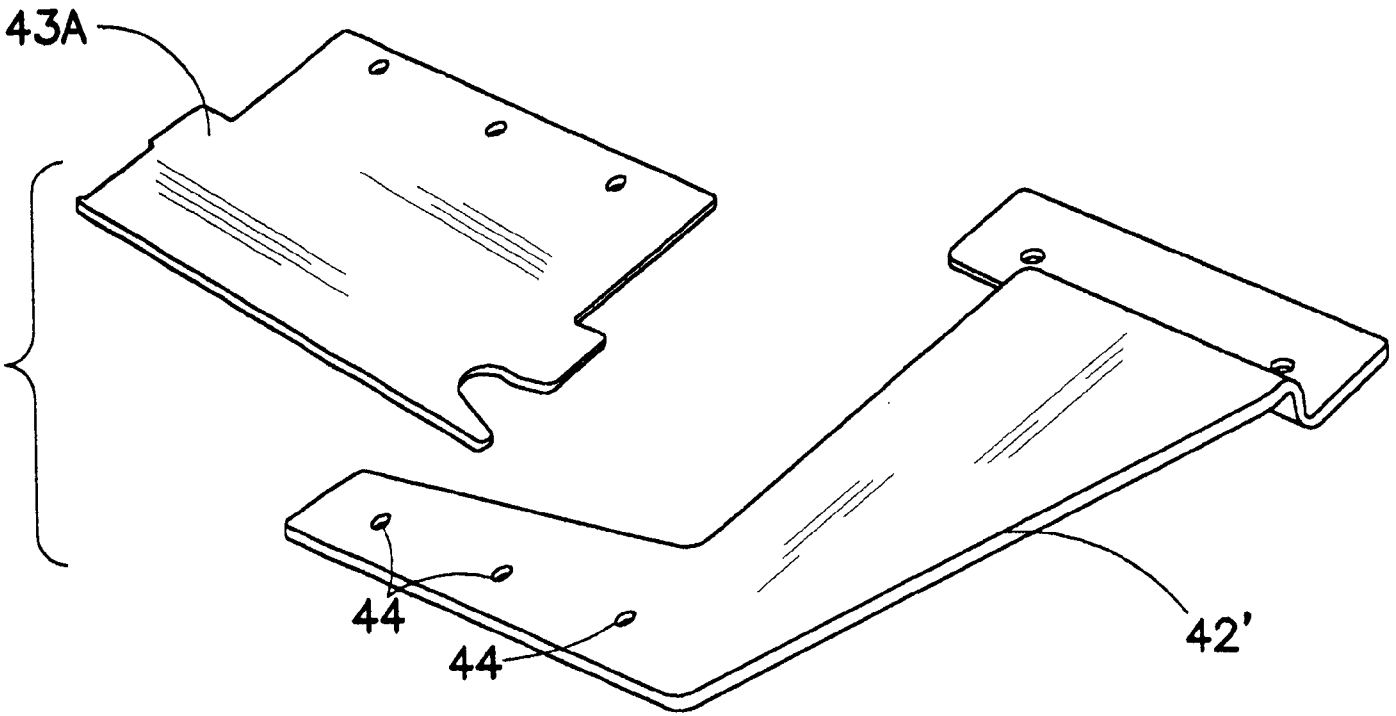
FIG. 2A is an exploded view of a mounting arm and adapter.

However, in the preferred embodiment of the present invention, adapter plates are mounted on the end of arms 42, 42' to adapt the embroidery frame to fit various models of machines. For this adaptable embroidery frame, the base 12, upper clamping mechanism 22, and clamping mechanism 32, are desirably the same or similar to those described in detail hereinabove. Referring to FIGS. 2 and 3, clamping frame 10 is shown with mounting arms 42' that, similar to the first aspect, attach to and extend generally outward from base 12. However, mounting arms 42' are dimensioned to receive adapters. Shown as 43A and 43B, adapters (shown here for an SWF machine) are selectively chosen to matingly engage with a particular model of embroidery machine. As best seen in FIG. 2A, arm 42' has a series of threaded holes 44 that are formed in its outer ends. Adapters 43A and 43B are easily attached to arms 42' with threaded fasteners 45. When attached together, embroidery frame 10 is ready to be mounted on the selected embroidery machine.

Figure 4:
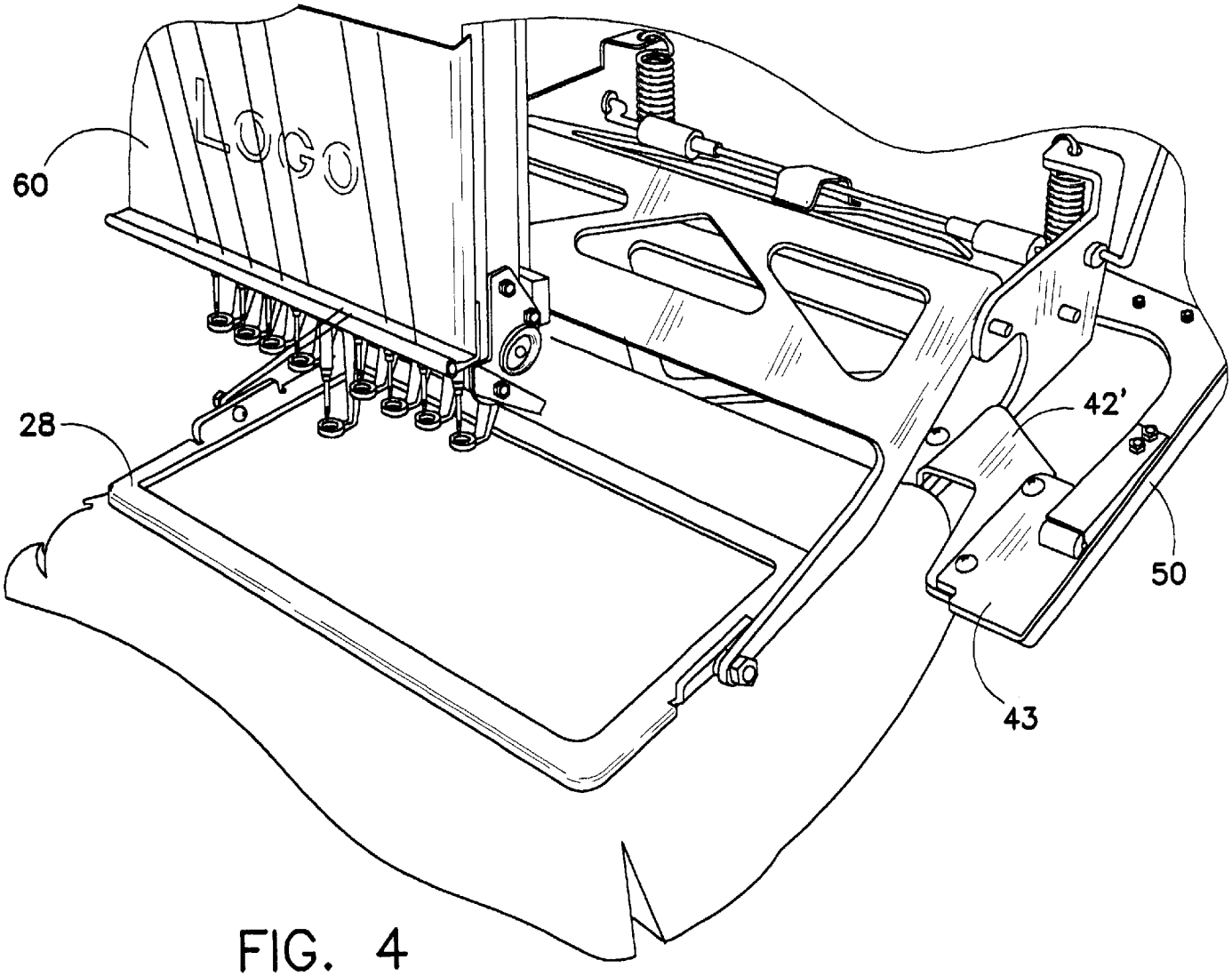
FIG. 4 is an environmental view of the embroidery frame of the present invention installed on a typical automated Brother embroidery machine.
Figure 5A:
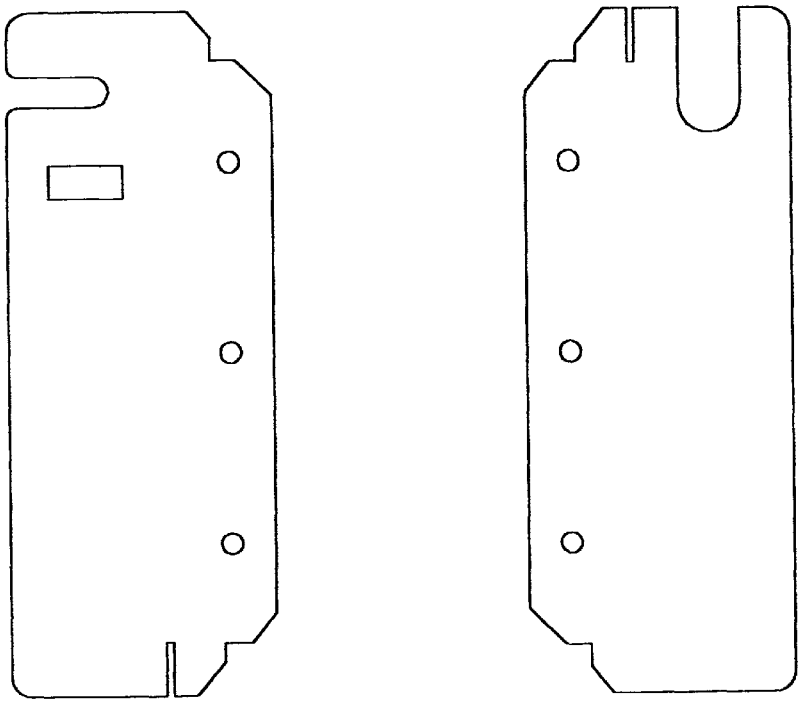
FIG. 5A is a top view of the adapters for a Melco embroidery machine.
Figure 5B:
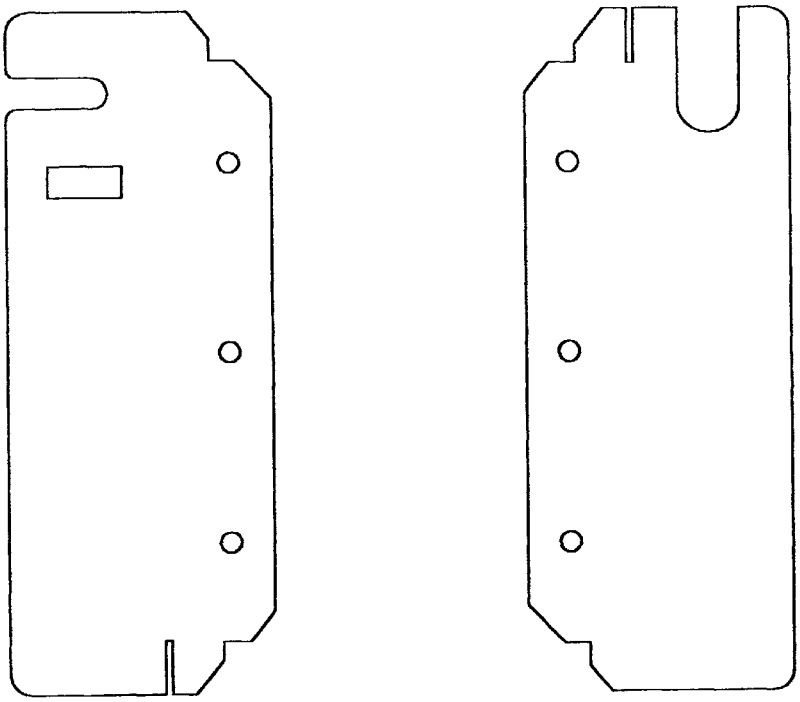
FIG. 5B is a top view of the adapters for a Banidan embroidery machine.
Figure 5C:
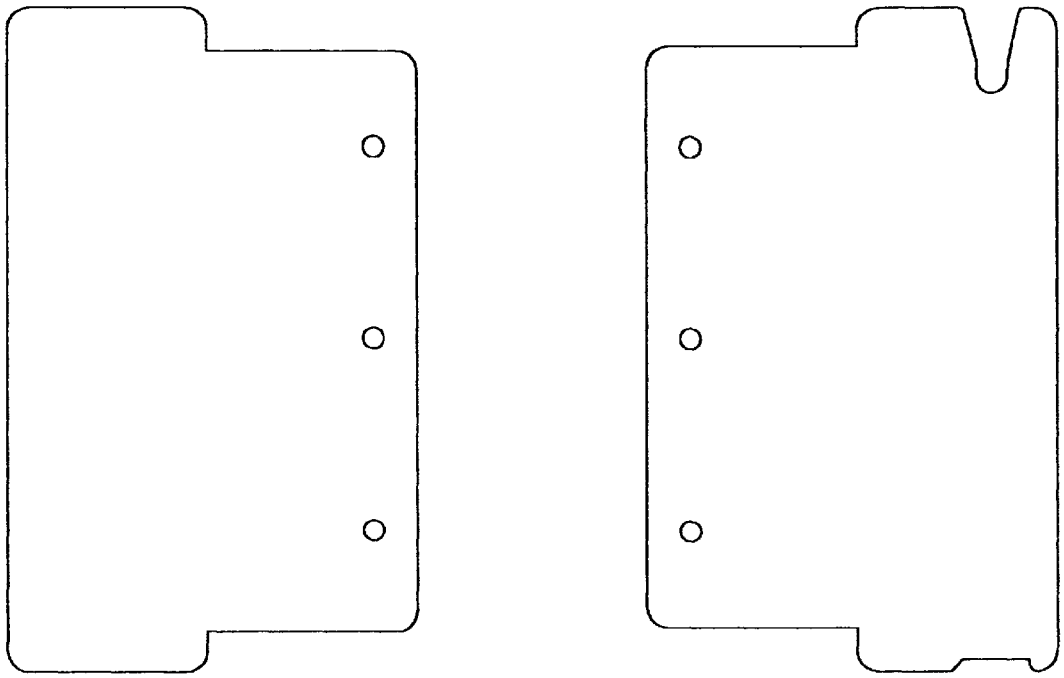
FIG. 5C is a top view of the adapters for a SWF embroidery machine.
Figure 5D:
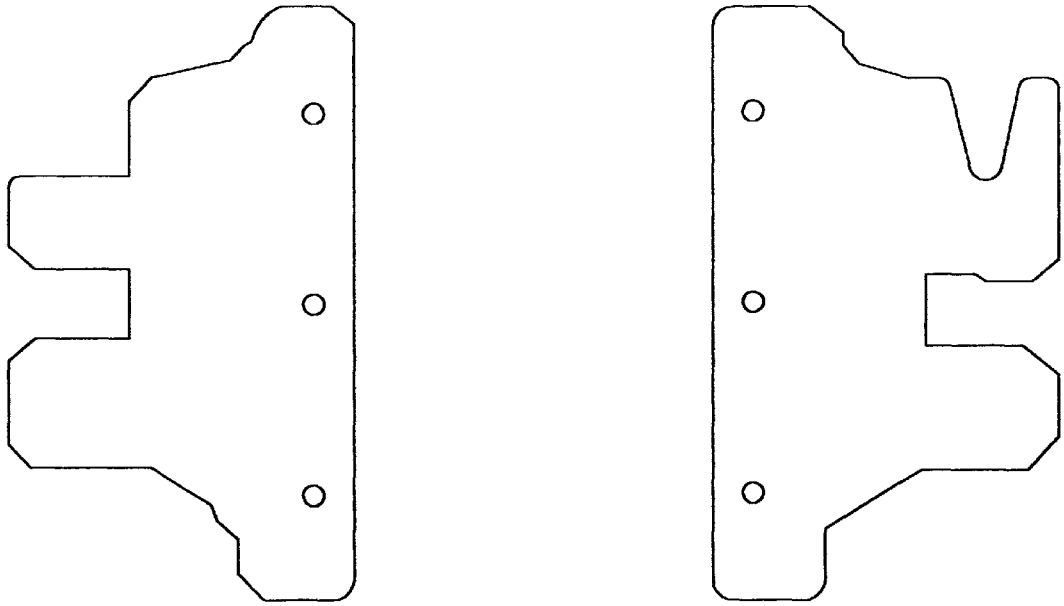
FIG. 5D is a top view of the adapters for a Tajima embroidery machine.
Figure 5E:
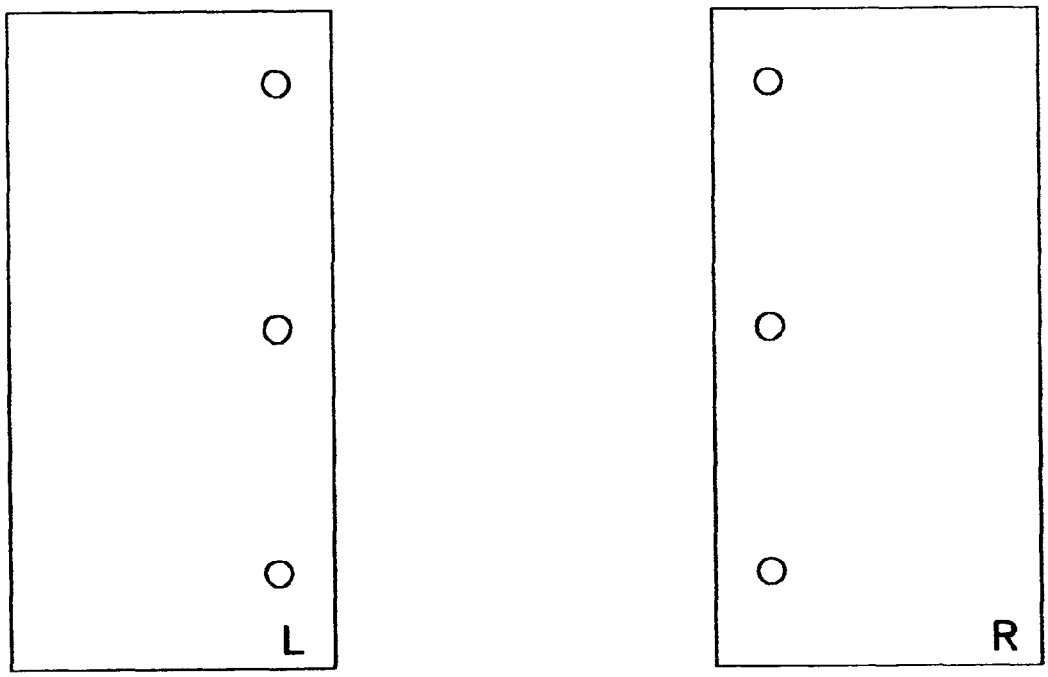
FIG. 5E is a top view of the adapters for a Brother embroidery machine.

FIG. 4 is an illustrative environmental view of the embroidery frame 10 mounted on a Brother machine illustrating how frame 28 defines an upper embroidery opening for the embroidery head 60. Adapters 43 are received by the arms 50 of the mounting carriage of the machine to securely hold embroidery frame 10 in place during embroidery operations. Arms 50 will, of course, vary in configuration, shape, and form of mating engagement from one model of machine to another, but the distance between the arms that form a station is substantially the same.

FIGS. 5A through 5D are illustrative, though not exhaustive, of typical adapter pairs that are interchangeably mounted to arms 42' of the present invention. FIGS. 5A through 5D schematically show adapter pairs for the Melco, Barudan, SWF, and Tajima machines, respectively.

Although the present invention has been described with a preferred embodiment, it is to be understood that modifications and variations may be utilized without departing from the spirit and scope of the invention, as those skilled in the art will readily understand. Such modifications and variations are considered to be within the purview and scope of the appended claims and their equivalents.

We claim:

1. An interchangeable embroidery frame for holding an article to be embroidered using automated embroidery equipment comprising:

(a) a base plate having opposed front and rear ends and opposed sides, said front and rear ends and sides defining a first embroidery opening therethrough;

(b) an upper clamping member pivotally connected to said base plate, said upper clamping member having a second embroidery opening formed therethrough, said second embroidery opening corresponding in size and registration to said first embroidery opening;

(c) a clamping mechanism for biasing said upper clamping member in closed contact with said base plate; and (d) a plurality of mounting arms attached to and extending outward from said base plate, said mounting arms so configured as to mate with different makes of automated embroidery machines.

2. The embroidery frame of claim 1 wherein each of said plurality of mounting arms is formed as a single piece.

3. The embroidery frame of claim 1 wherein each of said plurality of mounting arms has an outer end configured to accept an adapter plate, a plurality of types of said adapter plates from which selected adapter plates are chosen and affixed for mating engagement with a specific model of automated embroidery machine, each of said adapter plates being so configured as to mount to the outer end of one of said arms, wherein the use of said adapter plates enable said embroidery frame to be interchangeably mounted on a variety of makes of automated embroidery machines.

4. The embroidery frame of claim 3 wherein said clamping mechanism includes:

(a) at least one spring for biasing the base plate and upper clamping member in closed contact, said at least one spring being attached to and extending between said upper clamping member and said base plate;

(b) a lever mechanism connected through a common fulcrum axis in said walls of said base plate for overcoming said bias in said at least one spring; and (c) wherein when the bias in said at least one spring is overcome said upper clamping member is separated therefrom said base plate.

5. A manually operable embroidery frame for holding an article to be embroidered using automated embroidery equipment comprising:

(a) a base plate having opposed front and rear ends and opposed sides, said front and rear ends and sides defining a first embroidery opening therethrough;

(b) an upper clamping member pivotally connected to said base plate, said upper clamping member having a second embroidery opening formed therethrough, said second embroidery opening corresponding in size and registration to said first embroidery opening;

(c) a clamping mechanism normally biasing said upper clamping member into closed contact with said base plate;

(d) a lever mechanism manually operable to selectively overcome said bias in said clamping mechanism to open said frame; and (e) mounting arms attached to and extending from said opposed sides of said base plate, said mounting arms having outer ends so configured as to matingly engage with different makes of said automated embroidery equipment.

6. The embroidery frame of claim 5 wherein said manual clamping mechanism includes:

(a) at least one spring connecting the base plate and upper clamping member and biasing the upper clamping member toward the clamping position;

(b) a lever engaging said upper clamping member for overcoming the bias in said spring, said lever mounted through a fulcrum axis formed in at least one of said walls of said base plate; and (c) wherein when said spring bias is overcome by said lever operation, said upper clamping member is separated therefrom said base plate.

7. The embroidery frame of claim 6 wherein said manual clamping mechanism further includes a second lever, said first and second levers connected through a common axis fulcrum in said walls of said base plate.

8. The embroidery frame of claim 5 wherein each of said mounting arms has an outer end configured to accept an adapter plate, a plurality of types of said adapter plates from which selected adapter plates are chosen and affixed for mating engagement with a specific model of automated embroidery machine, each of said adapter plates being so configured as to mount to the outer end of one of said arms, wherein the use of said adapter plates enable said embroidery frame to be interchangeably mounted on a variety of makes of automated embroidery machines.

9. A manually operable and interchangeable embroidery frame for holding an article to be embroidered using automated embroidery equipment comprising:

(a) a substantially flat base plate having:

(i) opposed front and rear ends and opposed sides;

(ii) a first embroidery opening defined by said front end and said opposed sides and spaced apart from said rear end;

(iii) walls formed integrally with and extending vertically upward from at least some portion of each of said opposed sides, said walls having top edges;

(iv) a plurality of mounting arms attached to and extending outwardly from said opposed sides of said base plate, each of said plurality of mounting arms having outer ends;

(v) wherein each of said plurality of mounting arms has an outer end configured to accept an adapter plate, a plurality of types of said adapter plates from which selected adapter plates are chosen and affixed for mating engagement with a specific model of automated embroidery machine, each of said adapter plates being so configured as to mount to the outer end of one of said arms, wherein the use of said adapter plates enable said embroidery frame to be interchangeably mounted on a variety of makes of automated embroidery machines;

(b) an upper clamping member pivotally mounted at a point between said walls of the base plate having:

(i) opposed front and rear ends and opposed sides;

(ii) an aim extending forwardly outward from each of said opposed sides, said arms in substantially parallel relation;

(iii) a frame having opposed ends and opposed sides, said frame pivotally mounted between said forwardly extending arms and defining a second embroidery opening therethrough;

(c) a clamping mechanism having:

(i) at least one spring connecting the base plate and upper clamping member and biasing the upper clamping member toward the clamping position;

(ii) at least one engagement lever positioned about a fulcrum axis in said walls of said base plate for overcoming the bias in said at least one spring;

(iii) wherein when the bias in said spring is overcome, said upper clamping member is separated from said base plate; and (d) wherein said first and second embroidery openings are substantially in registration when said base plate and said upper clamping member are in closed contact.

* * * * *